US008890009B2

(12) United States Patent
Nitert et al.

(10) Patent No.: US 8,890,009 B2
(45) Date of Patent: Nov. 18, 2014

(54) DISCONNECTOR FOR SWITCHGEAR

(75) Inventors: Gerhardus Leonardus Nitert, Enter (NL); Arend Jan Willem Lammers, Hengelo (NL)

(73) Assignee: Eaton Industries (Netherlands) B.V., Hengelo (NL)

( * ) Notice: Subject to any disclaimer, the term of this patent is extended or adjusted under 35 U.S.C. 154(b) by 876 days.

(21) Appl. No.: 13/001,799

(22) PCT Filed: Jul. 2, 2009

(86) PCT No.: PCT/EP2009/058324

§ 371 (c)(1),
(2), (4) Date: Dec. 29, 2010

(87) PCT Pub. No.: WO2010/000799

PCT Pub. Date: Jan. 7, 2010

(65) Prior Publication Data

US 2011/0108398 A1 May 12, 2011

(30) Foreign Application Priority Data

Jul. 2, 2008 (EP) ..... 08159506

(51) Int. Cl.

| | |
|---|---|
| ***H01H 13/00*** | (2006.01) |
| ***H01H 15/00*** | (2006.01) |
| ***H01H 31/24*** | (2006.01) |
| ***H01H 3/46*** | (2006.01) |
| ***H01H 31/32*** | (2006.01) |
| *H01H 1/42* | (2006.01) |
| *H01H 1/38* | (2006.01) |

(52) U.S. Cl.

CPC ..... *H01H 31/24* (2013.01); *H01H 1/42* (2013.01); *H01H 1/38* (2013.01); *H01H 3/46* (2013.01); *H01H 31/32* (2013.01)

USPC ..... 200/16 C; 200/48 R

(58) Field of Classification Search

USPC ..... 200/16 C, 48 R, 48 A, 48 P, 48 V, 50.39, 200/48 KB, 48 SB, 48 CB

See application file for complete search history.

(56) References Cited

U.S. PATENT DOCUMENTS

| | | | | |
|---|---|---|---|---|
| 2,517,435 | A | 8/1950 | Jensen | |
| 3,182,145 | A | 5/1965 | Gorman | |
| 3,562,460 | A | 2/1971 | Koerner | |
| 5,091,616 | A * | 2/1992 | Ramos et al. | 218/9 |
| 2008/0217153 | A1 * | 9/2008 | Bottcher et al. | 200/48 R |

* cited by examiner

*Primary Examiner* — Renee Luebke
*Assistant Examiner* — Lheiren Mae A Caroc
(74) *Attorney, Agent, or Firm* — Eckert Seamans Cherin & Mellott, LLC; Kirk D. Houser; Philip E. Levy

(57) ABSTRACT

Disconnector for switchgear, having a first contact position, in which a contact is between main and first terminals, and a second contact position, in which a contact is between the main and second terminal. The disconnector includes a connector body moveable in a first direction between the first and second positions and having an end extendable in a direction substantially perpendicular to the first direction for providing a contact force between the end and the first, second or main terminals, a first operating mechanism arranged to move the body between the first and second positions, and a second operating mechanism arranged to extend the end when the disconnector is in either the first or second contact positions, in which the end includes a conical inside surface and the second operating mechanism includes a first shaft having a first conically shaped end positioned inside the conical inside surface.

12 Claims, 3 Drawing Sheets

17
11
10
17
9
8
16
7
6
21
5
4
3
21
2
1
16

11
10
8
7
9
21
5
6
3
4
21
2
1

11
10
8
7
9
5
4
3
2
6
1

DISCONNECTOR FOR SWITCHGEAR

FIELD OF THE INVENTION

The present invention relates to a disconnector for a switch gear system having a first contact position, in which an electrical contact is provided between a main terminal and a first terminal (e.g. a rail or bus of the switchgear), and a second contact position, in which an electrical contact is provided between the main terminal and a second terminal (e.g. a ground terminal of the switchgear).

PRIOR ART

Such a disconnector is well known in present day medium voltage switchgears, usually in the form of an embodiment having sliding contacts. As the disconnector is normally operated in a switched off system (i.e. not having to switch electrical currents), it is possible to use relatively low cost and simple contact terminals. However, the vulnerability of such contact terminals has resulted in prescribed characteristics of the disconnector. The contact resistance has to remain within certain boundaries (e.g. 10%), also after a durability test of for example 1000 switch actions. At the maximum nominal current, a temperature raise of 65 degrees must not be exceeded. These requirements are hard to meet using present day disconnector implementations.

US patent publication U.S. Pat. No. 2,517,435 discloses a disconnect switch in which a stationary tubular contact is provided, comprising two half-cylindrical sections and two clamping plates held together by a bolt and nut. The stationary tubular contact is arranged to receive a movable contact sleeve assembly. The moveable contact sleeve assembly comprises an outer bifurcated cylindrical sleeve and two spreading members. Between the spreading members a cam piece co-operates with rollers allowing a force to be exerted on the spreading member in a direction perpendicular to the movement direction of contact sleeve assembly.

US patent publication U.S. Pat. No. 3,562,460 discloses a double contact disconnect switch. In a tubular arrangement, a disconnector assembly is provided between two stationary contacts. The disconnector assembly is arranged to move two conducting members into contact with the contacts using a rotating operation mechanism.

SUMMARY OF THE INVENTION

The present invention seeks to provide a disconnector with a more reliable operation during its entire service life, while also providing a simple and cost-effective construction.

According to the present invention, a disconnector according to claim 1 is provided. This disconnector achieves a higher contact force in the first or second position in comparison with a prior art disconnector using sliding contacts, and at the same time only needs a low force for moving between the first and second position.

Advantageously the first and second operating mechanism are combined in a single operating mechanism, which allows to having a single operating member (such as an arm or lever) to operate the disconnector.

In one embodiment, the connector body has a fixed electrical connection to the main terminal and rotates between the first and second position.

The second operating mechanism comprises a lever mechanism for extending the end portion into forced contact with either the first or second terminal and the lever mechanism comprises a roller and cam mechanism. This provides an efficient mechanism which results in a high force to press the end portion in contact with the terminal.

The connector body is preferably a hollow body (e.g. of copper material) provided with at least one slit in longitudinal direction of the connector body at the end portion of the connector body. This allows extension of the end portion of the connector body between the slits in a resilient manner, thus allowing good electrical contact in the first or second position, but also sufficiently low friction when moving the connector body.

In a further embodiment, the connector body is provided with two end portions which are extendable in a direction substantially perpendicular to the first direction for providing a contact force between the end portions and the main and first terminal, or between the end portions and the main and second terminal respectively. This results in an even force being applied to the two end portions (i.e. the disconnector makes contacts a both sides—bus and ground side—in an equal manner), and a reliable electrical contact.

In the embodiment of a connector body having two extendible end portions, the slits at both end portions preferably partially overlap in the middle of the connector body. This provides a higher resiliency.

Preferably each end portion of the connector body is provided with a conical inside surface, and the second operating mechanism comprises a second shaft which is provided with a second conically shaped end body, said conically shaped end bodies being positioned inside the conical inside surfaces of the end portions of the connector body. This allows a simple and effective operating mechanism, in which the conically shaped end bodies can extend the end portions of the connector bodies.

In a further embodiment, the second operating mechanism further comprises an operating lever which is attached to the first shaft and in operation abuts an edge of the second shaft. This allows to having an operating mechanism requiring only a single movement for moving the connector body as well as extending the end portions thereof in the first or second position.

The first and second conically shaped end bodies are spring loaded to push each other away. In a situation where the lever is not moved and no force is exerted on the lever, this would result in a release of the force on the ends of the connector body. The spring load on the first and second conically shaped end bodies is sufficient to allow sliding of the connector body in a sliding position of the operating lever. This allows for a low moving force and low wear on the terminals and connector body.

SHORT DESCRIPTION OF DRAWINGS

The present invention will be discussed in more detail below, using a number of exemplary embodiments, with reference to the attached drawings, in which FIG. 1 shows a cross-sectional view of a first embodiment of the disconnector according to the present invention;

Figures 4A, 4B, 4C:
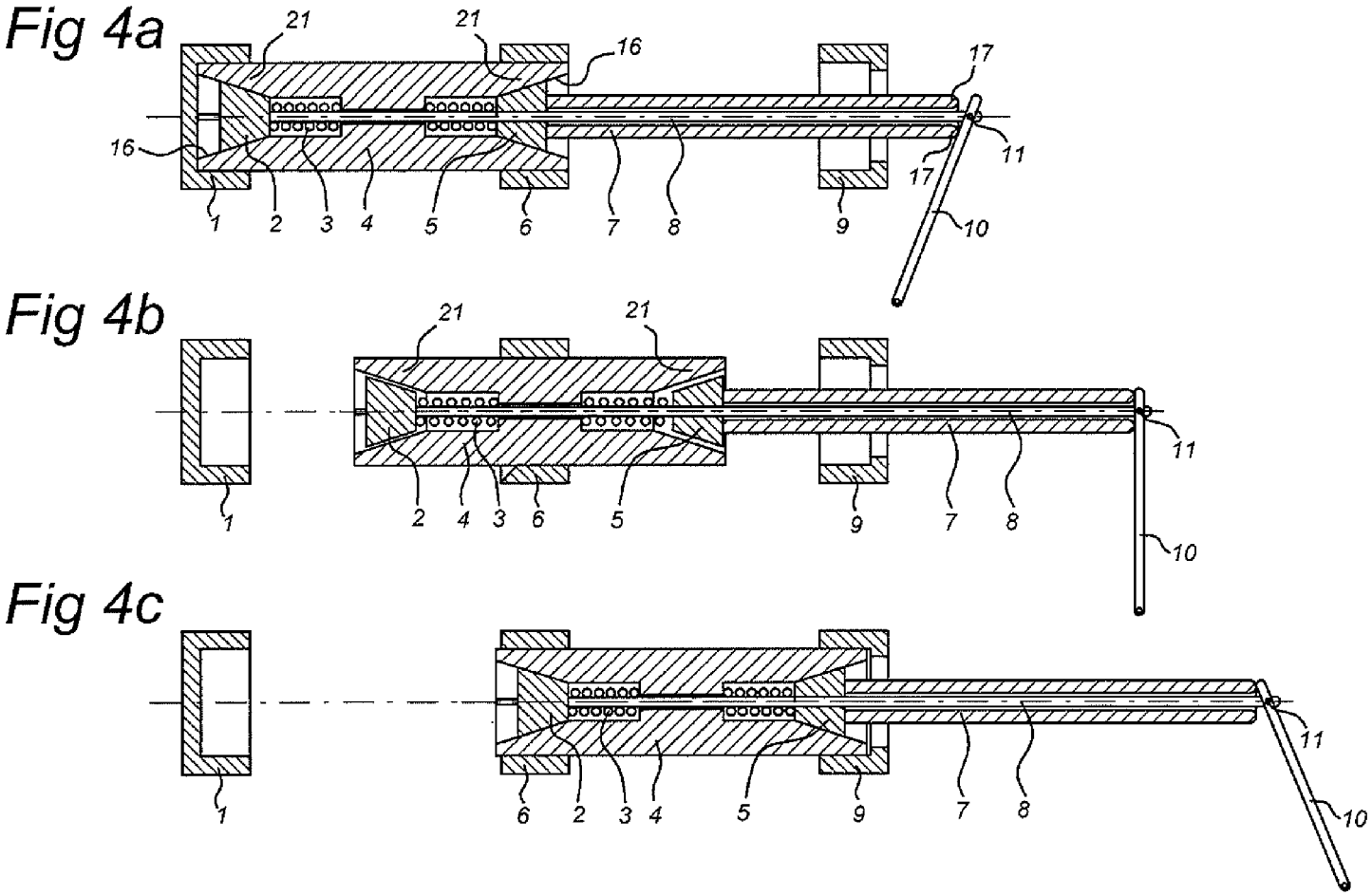

FIG. 4*a*-4*c* show cross-sectional views of a disconnector according to a further embodiment in a first, intermediate and second position.

DETAILED DESCRIPTION OF EXEMPLARY EMBODIMENTS

Figure 1:
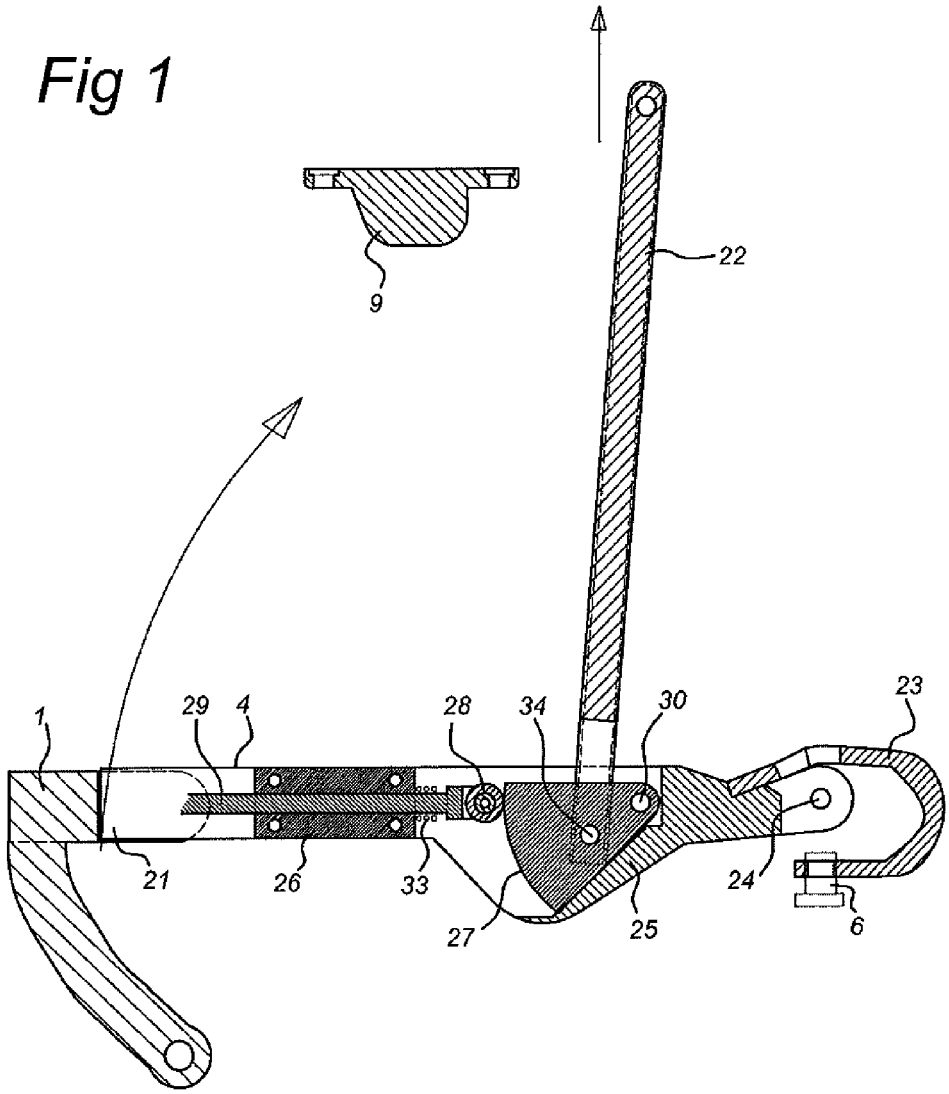

In FIG. 1, a first embodiment of a disconnector for a switchgear is shown schematically, partly in cross sectional view. The disconnector is arranged to provide an electrical connection between a main terminal 6 (connected to the connector body 4 using a Litze connection 23) and either a first terminal 1 (connected to e.g. a rail of the switchgear system) or a second terminal 9 (connected e.g. to ground, i.e. earth potential). The disconnector is moved in a first direction between a first position (connecting main terminal 6 to first terminal 1) and a second position (connecting main terminal 6 to second terminal 9) by a drive rod 22 connected to connector body 4 (providing a first operating mechanism). In the embodiment shown in FIG. 1 the first direction is a tangential direction around a fixed journal point 24.

In the embodiment shown in FIG. 1, the connector body 4 moves in a swaying manner around fixed journal point 24 from the first to second position and back. According to the present invention, a contact force between an end part 21 of connector body 4 and the first or second terminal 1, 9 can be applied by a special arrangement in order to provide a fixed like electrical contact, i.e. the electrical connection between first or second terminal 1, 9, on the one hand, and end part 21 of connector body 4, on the other hand, is as if two contact elements (1, 9; 21) were bolted together, i.e. the contact made is regarded as equivalent to a bolted contact. This allows higher temperatures for these electrical connections, i.e. with maximum rated current, the temperature at the connections points may now raise with 75° C. as opposed to 65° C. for the usual sliding contacts.

The above characteristics are made possible according to the present invention by an end portion 21 of the connector body 4 which is extendable in a direction substantially perpendicular to the first direction, i.e. the direction of movement of the end portion 21 of connector body 4. In the embodiment shown in FIG. 1, the connector body 4 sways from the first to second position, i.e. the first direction is a tangential direction around the fixed journal point 24 (i.e. in the drawing plane of FIG. 1). The end portion 21 is extendable in the direction perpendicular to this first direction, i.e. perpendicular to the drawing plane of FIG. 1.

Figure 2:
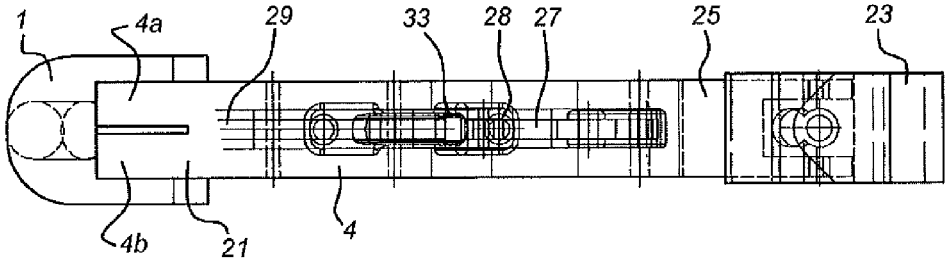
FIG. 2 shows a top view of the disconnector of FIG. 1.

In FIG. 2, a top view is shown of the disconnector embodiment of FIG. 1. In this embodiment, the first terminal 1 is provided as a U shaped terminal, in which the end part 21 of the connector body 4 is received to make contact. The end part 21 of the connector body 4 in this embodiment comprises two end parts 4*a*, 4*b*, which can be pushed away from each other, in order to make forceful contact with terminal 1. The end parts 4*a*, 4*b* together have a conically shaped inner surface which is not visible in FIG. 2 but is similar to what is depicted in the cross-sectional views of FIG. 4*a*-4*c*.

The end part 21 is extendable in a direction substantially perpendicular to the first direction (i.e. perpendicular to the drawing plane of FIG. 1, or in a vertical direction in the drawing plane of FIG. 2). This is made possible in the embodiment shown in FIGS. 1 and 2 using a second operating mechanism comprising a cam 27 and roller 28 arrangement and a clamping mechanism comprising a cone shaped element cooperating with the conically shaped combined inside surface of the end parts 4*a*, 4*b* (although shown in a double embodiment, similar to the clamping mechanism of FIG. 4*a*-4*c*). The second operating mechanism comprises a cam 27, which is pivotally fixed to the connector body 4 using a pivot 30 and connected to drive rod 22 using a connector 34. The roller 28 is attached to a push rod 29, which is connected to the connector body 4 using a bearing block 26. This bearing block 26 assures that the push rod 29 can only move in the longitudinal direction of connector body 4. At the other end, push rod 29 is connected to the cone shaped element, which is arranged to cooperate with the end parts 4*a*, 4*b*. As a result, the end part 4*a*, 4*b* are pushed outwardly when the push rod 29 moves, thus forming a lever mechanism. The second operating mechanism is furthermore provided with a spring 33 between bearing block 26 and roller 28 in order to assure that the roller 28 stays in contact with the cam 27.

The cam 27 is shaped and attached to allow a linear movement of push rod 29 when the disconnector is either in the first or second position. In these two positions, the end part 21 is aligned with the first or second terminal 1, 9, and a further movement of drive rod 22 results in a movement of push rod 29 and an extension of the end parts 4*a*, 4*b*. This results in a high contact force between end part 21 and first or second terminal 1, 9. In fact, the first operating mechanism (for changing from first to second position) and second operating mechanism (for extending the end portion 21 to make a fixed-like electrical contact) can be viewed as a single operating mechanism, controlled by drive rod 22. Rod 22 can be actuated by moving its free end in a linear direction (in the drawing in vertical direction). A simple linear actuator such as an (air) cylinder or spindle can be used for actuating the rod 22.

Figure 3:
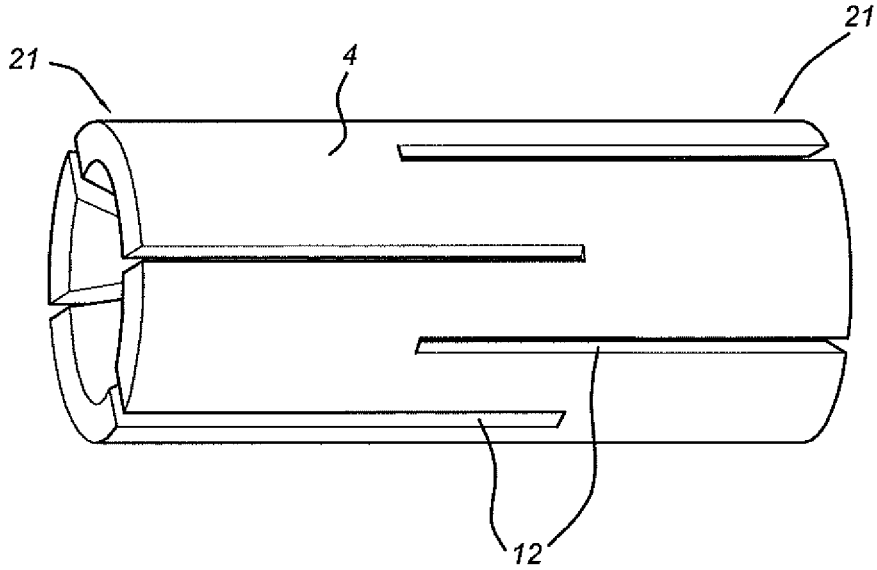
FIG. 3 shows a perspective view of a connector body.

Further embodiments of the present invention are shown in the cross sectional views of FIGS. 3 and 4. In these embodiments, the connector body 4 is arranged to make a lateral motion relative to main terminal 6, i.e. the first direction is parallel to an axis of the connector body 4. Two end portions 21 of the connector body 4 make electrical contact between the main terminal 6 and first terminal 1 in a first position (shown in FIG. 4*a*) or between the main terminal 6 and second terminal 9 in a second position (shown in FIG. 4*c*). Movement of the connector body 4 is in the first direction that coincides with a longitudinal axis of connector body 4, and is accomplished using an operating rod 8, which extends through second terminal 9. In these embodiments, the connector body 4 comprises end portions 21 which are extendable in a direction perpendicular to the first direction. In further alternatives, the connector body 4 may comprise two or more end portions 21, which are each provided with connector body segments which are mutually moveable in a radial direction of the connector body (i.e. perpendicular to the first direction).

In a further embodiment, the end portions 21 may be provided with silver plating or gold plating to allow a long service life of the disconnector with sustained low contact resistance.

In the embodiment as shown in FIGS. 3 and 4, the connector body 4 is a hollow body (e.g. of copper material) provided with at least one slit 12 in a longitudinal direction of the connector body 4, at each end portion 21. In the embodiment shown in FIG. 3, multiple slits 12 are provided, and the slits partially overlap in a circumferential direction of the connector body 12 in the middle part of the connector body 4. This actually forms multiple segments at the end portions 21, which can extend in a radial direction of the connector body 4.

The end portions 21 are provided with conically shaped inside surfaces 16, which form part of the second operating mechanism intended to extend the end portions 21 in a radial direction (i.e. perpendicular to the first direction, i.e. the movement direction of the connector body 4). The second operating mechanism in this embodiment furthermore comprise an operating rod, which in this embodiment comprises a first shaft 8 provided with a first conically shaped end body 2, and a second shaft 7 provided with a second conically shaped end body 5. The second shaft 7 surrounds the first shaft 8 coaxially in an advantageous embodiment, providing self alignment and easy operation. The first and second conically shaped end bodies 2, 5 are positioned inside the conical inside surfaces 16 of connector body 4. The connector body 4 is furthermore provided with springs 3 abutting the conically shaped end bodies 2, 5, which exert a force biasing the conically shaped end bodies 2, 5 in a direction away from the conical inside surfaces 16.

An operating lever 10 is provided, which is connected to the first shaft 8 using a pivoting connection 11. The operating lever 10, in operation, abuts an edge 17 of the second shaft 7. When moving the lever 10 to the left or right, starting from a position as depicted in FIG. 4*b*, this results in a movement to the left or right of the entire connector body 4.

This structure also allows a lever action resulting in a relative movement of first and second shaft 7, 8 in either the first or second position, when the connector body 4 is stopped by either the first or second terminal 1, 9. As a result, the first and second conically shaped end bodies 2, 5 move towards each other (as shown in FIG. 4*a* and FIG. 4*c*), exerting an outwardly directed force on the end portions 21 via the conical inside surfaces 16 thereof, and assuring a fixed like electrical contact. In the first or second position, this force can be applied by the lever 10 abutting the edge of second shaft 7. Using this embodiment, a big contact surface and high contact pressure is provided in the first and second position when exerting force on lever 10, resulting in a very low electrical resistance. Furthermore, during movement of the connector body 4 there is no contact pressure, as a result of which a very low moving force is needed, and no or little contact wear on the terminals 1, 6, 9, occurs. Also, the operating mechanism is combined as a single operating mechanism for both switching the disconnector between the first and second position, and to extend the end portions 21 of the disconnector to build up contact pressure.

In all the embodiments described above, the first and second shafts 7, 8 may be made of electrically insulating material. This allows easy assembly and also safe operation of the disconnector in an environment with other electrical conductors.

Furthermore, in order to assure an electrical contact with a sufficiently low contact resistance, a contact surface between the connector body 4 and first or second terminal is at least as large as a contact surface between the connector body 4 and the main terminal 6.

As described above, the clamping mechanism utilizing the conically shaped inside surface(s) 16 and conically shaped end bodies 2, 5, may be provided in a single contact embodiment or a double contact embodiment. Furthermore, the movement of the connector body 4 may be accomplished by moving the lever 10, drive rod 22 or equivalent operating mechanism, using a linear actuator such as a spindle or an (air) cylinder to provide a linear stroke to the free end of the lever 10 or drive rod 22. The stroke for the FIG. 4 embodiment is as a large as the distance between the free end of lever 10 shown in FIG. 4*a* and the free end of lever 10 shown in FIG. 4*c*.

The above embodiments have been described as examples of implementations of the present inventions. On details, changes and modifications are possible within the scope of the present invention. The scope is defined by the claims as appended, including equivalents of features mentioned.

The invention claimed is:

1. Disconnector for switchgear, having a first contact position, in which an electrical contact is provided between a main terminal and a first terminal, and a second contact position, in which an electrical contact is provided between the main terminal and a second terminal, the disconnector comprising:

a connector body which is moveable in a first direction between the first and second contact positions and provided with an end portion which is extendable in a direction substantially perpendicular to the first direction for providing a contact force between the end portion and the first, second or main terminals, a first operating mechanism which is arranged to move the connector body between the first and second contact positions, and a second operating mechanism which is arranged to extend the end portion of the connector body when the disconnector is in either the first or second contact position, in which the end portion of the connector body is provided with a conical inside surface and the second operating mechanism comprises a first shaft provided with a first conically shaped end body positioned inside the conical inside surface of the end portion of the connector body, in which the connector body has a fixed electrical connection to the main terminal and rotates between the first and second contact positions, in which the second operating mechanism comprises a lever mechanism for extending the end portion into forced contact with either the first or second terminal, and in which the lever mechanism comprises a roller and cam mechanism.

2. Disconnector according to claim 1, in which the first operating mechanism and the second operating mechanism are combined in a single operating mechanism.

3. Disconnector according to claim 1, in which the connector body has a fixed electrical connection to the main terminal and rotates between the first and second contact positions.

4. Disconnector for switchgear, having a first contact position, in which an electrical contact is provided between a main terminal and a first terminal, and a second contact position, in which an electrical contact is provided between the main terminal and a second terminal, the disconnector comprising:

a connector body which is moveable in a first direction between the first and second contact positions and provided with an end portion which is extendable in a direction substantially perpendicular to the first direction for providing a contact force between the end portion and the first, second or main terminals, a first operating mechanism which is arranged to move the connector body between the first and second contact positions, and a second operating mechanism which is arranged to extend the end portion of the connector body when the disconnector is in either the first or second contact position, in which the end portion of the connector body is provided with a conical inside surface and the second operating mechanism comprises a first shaft provided with a first conically shaped end body positioned inside the conical inside surface of the end portion of the connector body, and in which the connector body is provided with two end portions which are extendable in a direction substantially perpendicular to the first direction for providing a contact force between the end portions and the main and first terminals or the end portions and the main and second terminals respectively.

5. Disconnector according to claim 4, in which the connector body is a hollow body, provided with at least one slit in longitudinal direction of the connector body at the end portion of the connector body.

6. Disconnector according to claim 4, in which each of two slits of said at least one slit is at a corresponding one of the two end portions, said two slits at the two end portions partially overlap in the middle of the connector body.

7. Disconnector for switchgear, having a first contact position, in which an electrical contact is provided between a main terminal and a first terminal, and a second contact position, in which an electrical contact is provided between the main terminal and a second terminal, the disconnector comprising:

a connector body which is moveable in a first direction between the first and second contact positions and provided with an end portion which is extendable in a direction substantially perpendicular to the first direction for providing a contact force between the end portion and the first, second or main terminals, a first operating mechanism which is arranged to move the connector body between the first and second contact positions, and a second operating mechanism which is arranged to extend the end portion of the connector body when the disconnector is in either the first or second contact position, in which the end portion of the connector body is provided with a conical inside surface and the second operating mechanism comprises a first shaft provided with a first conically shaped end body positioned inside the conical inside surface of the end portion of the connector body, in which the connector body is a hollow body, provided with at least one slit in longitudinal direction of the connector body at the end portion of the connector body, and in which the connector body is provided with two end portions and each of two slits of said at least one slit is at a corresponding one of the two end portions, said two slits at the two end portions partially overlap in the middle of the connector body.

8. Disconnector according to claim 7, in which each end portion of the connector body is provided with a conical inside surface, and in which the second operating mechanism comprises a second shaft which is provided with a second conically shaped end body, the first and second conically shaped end bodies being positioned inside the conical inside surfaces of the end portions of the connector body.

9. Disconnector for switchgear, having a first contact position, in which an electrical contact is provided between a main terminal and a first terminal, and a second contact position, in which an electrical contact is provided between the main terminal and a second terminal, the disconnector comprising:

a connector body which is moveable in a first direction between the first and second contact positions and provided with an end portion which is extendable in a direction substantially perpendicular to the first direction for providing a contact force between the end portion and the first, second or main terminals, a first operating mechanism which is arranged to move the connector body between the first and second contact positions, and a second operating mechanism which is arranged to extend the end portion of the connector body when the disconnector is in either the first or second contact position, in which the end portion of the connector body is provided with a conical inside surface and the second operating mechanism comprises a first shaft provided with a first conically shaped end body positioned inside the conical inside surface of the end portion of the connector body, in which the connector body is provided with two end portions which are extendable in a direction substantially perpendicular to the first direction for providing a contact force between the end portions and the main and first terminals or the end portions and the main and second terminals respectively, in which each end portion of the connector body is provided with a conical inside surface, and in which the second operating mechanism comprises a second shaft which is provided with a second conically shaped end body, the first and second conically shaped end bodies being positioned inside the conical inside surfaces of the end portions of the connector body.

10. Disconnector according to claim 9, in which the second operating mechanism further comprises an operating lever which is attached to the first shaft and in operation abuts an edge of the second shaft.

11. Disconnector according to claim 10, in which the first and second conically shaped end bodies are spring loaded to push each other away.

12. Disconnector according to claim 9, in which the first and second conically shaped end bodies are spring loaded to push each other away.

* * * * *